US008337575B2

(12) United States Patent
Sabourin

(10) Patent No.: US 8,337,575 B2
(45) Date of Patent: Dec. 25, 2012

(54) METHOD AND SYSTEM FOR TREATING POLLUTED GASES

(76) Inventor: Hubert Sabourin, Alexandria (CA)

( * ) Notice: Subject to any disclaimer, the term of this patent is extended or adjusted under 35 U.S.C. 154(b) by 409 days.

(21) Appl. No.: 12/593,794

(22) PCT Filed: Apr. 9, 2009

(86) PCT No.: PCT/CA2009/000508

§ 371 (c)(1),
(2), (4) Date: May 5, 2010

(87) PCT Pub. No.: WO2009/124402

PCT Pub. Date: Oct. 15, 2009

(65) Prior Publication Data

US 2011/0138759 A1 Jun. 16, 2011

(30) Foreign Application Priority Data

Apr. 10, 2008 (CA) ..... 2631309

(51) Int. Cl.
*B01D 50/00* (2006.01)

(52) U.S. Cl. ..... 55/283; 55/300; 55/341.1; 55/432; 55/471

(58) Field of Classification Search ..... 55/283, 55/300, 341.1, 432, 467, 471
See application file for complete search history.

(56) References Cited

U.S. PATENT DOCUMENTS

| | | | |
|---|---|---|---|
| 3,385,033 | A | 5/1968 | Basore et al. |
| 3,779,709 | A | 12/1973 | Yamada |
| 4,193,780 | A | 3/1980 | Worth et al. |
| 4,372,927 | A | 2/1983 | McCullough |
| 4,566,882 | A | 1/1986 | Hoffman et al. |
| 4,764,355 | A | 8/1988 | Romey et al. |
| 4,808,203 | A | 2/1989 | Sabourin |
| 4,983,434 | A | 1/1991 | Sassa |
| 5,112,368 | A | 5/1992 | Gosselin |
| 5,338,339 | A | 8/1994 | Westphal |
| 5,359,946 | A | 11/1994 | Asoh et al. |
| 5,478,372 | A | 12/1995 | Stark |
| 5,800,790 | A | 9/1998 | Imamura et al. |
| 6,752,847 | B2 | 6/2004 | Smithies |
| 2003/0192294 | A1 | 10/2003 | Smithies |

FOREIGN PATENT DOCUMENTS

| | | | |
|---|---|---|---|
| CA | 1234360 | | 3/1988 |
| CA | 1264314 | | 1/1990 |
| CA | 2631309 | | 11/2008 |
| JP | 2004321970 A | * | 11/2004 |
| WO | WO 2009/124402 | | 10/2009 |

* cited by examiner

*Primary Examiner* — Robert A Hopkins
(74) *Attorney, Agent, or Firm* — Woodcock Washburn LLP

(57) ABSTRACT

The present invention relates to a method and a system for treating polluted gases prior to their emission into the atmosphere. The system comprises a treatment chamber having an inlet for receiving polluted gas and an outlet for expelling treated gas, the treatment chamber including at least one treatment cell having a filtering layer for treating the polluted gas when the polluted gas comes in contact with the filtering layer. The system also contains a powder container connected to the treatment chamber such that air laden with the powder can flow to the treatment chamber to form a filtering layer on the at least one treatment cell. The system contains an air flow generator connected to the outlet of the treatment chamber and to the container which is connected to the treatment chamber, for causing air flow to the container, to the treatment chamber and in the environment.

16 Claims, 9 Drawing Sheets

METHOD AND SYSTEM FOR TREATING POLLUTED GASES

CROSS REFERENCE TO RELATED APPLICATIONS

This application is the National Stage entry of International Application No. PCT/CA2009/000508, filed Apr. 9, 2009, which claims the benefit of Canadian Patent Application No. 2,631,309 filed on Apr. 10, 2009, the disclosures of which are incorporated herein by reference in their entirety.

FIELD OF THE INVENTION

The present invention relates to a method and a system for treating polluted gases, and is particularly, though not exclusively, concerned with a method and a system for treating polluted gases prior to their emission into the atmosphere.

BACKGROUND OF THE INVENTION

To meet the air pollution control requirement and to maintain levels of air quality, the concentration of air contaminants due to all sources should not exceed the standards established by the environmental regulations. Therefore, to reduce the level of air contaminants emitted, polluting industries, hospitals, incinerators, electricity generating installations or the like should possess air pollution control equipments to eliminate, prevent, reduce, control or regulate the emission of specified air contaminants into the atmosphere.

A technique for reducing the level of air contaminants emitted from polluting industries is to remove undesirable particles, e.g. soot and ash, carried in polluted gases or smoke and to reduce the volume of harmful gases by filtration. It is desirable to improve on these existing systems.

SUMMARY OF THE INVENTION

An object of the invention is to provide a new method and system for treating polluted gases. By polluted gas is meant any gas which can be considered a pollutant, for example gasses including particles such as smoke or ash.

Accordingly, the present invention provides a method and a system that remove particulate matter and reduces noxious gases from a stream of polluted gases produced by fabrication or combustion processes such as found in many industries.

BRIEF DESCRIPTION OF THE DRAWINGS

In order that this invention may be more readily understood, currently preferred embodiments will now be further described by way of example with reference to the accompanying drawings in which.

DETAILED DESCRIPTION OF THE INVENTION

Figure 1:
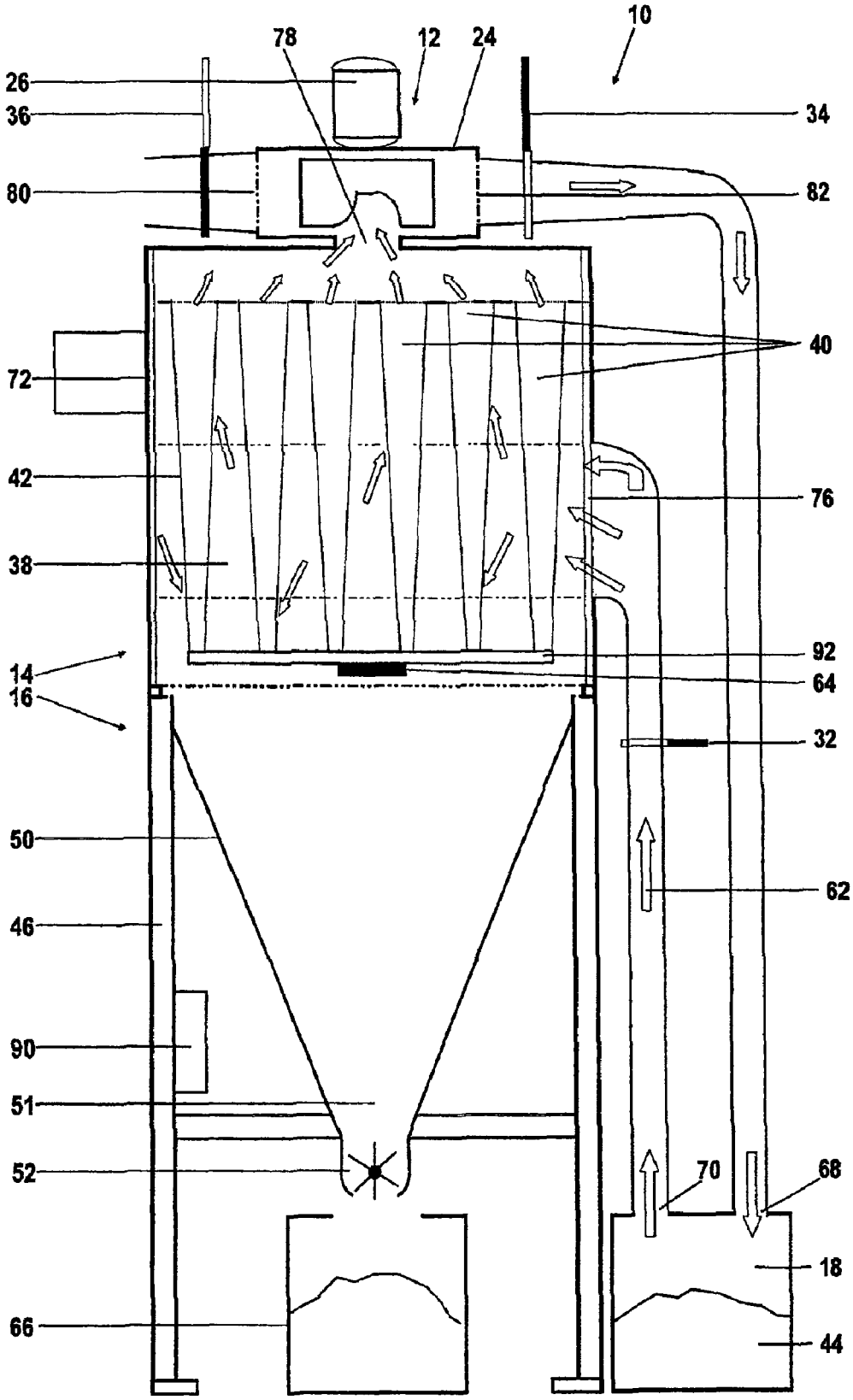
FIG. 1 is a front view of a treatment unit of an embodiment of the present invention.
Figure 2:
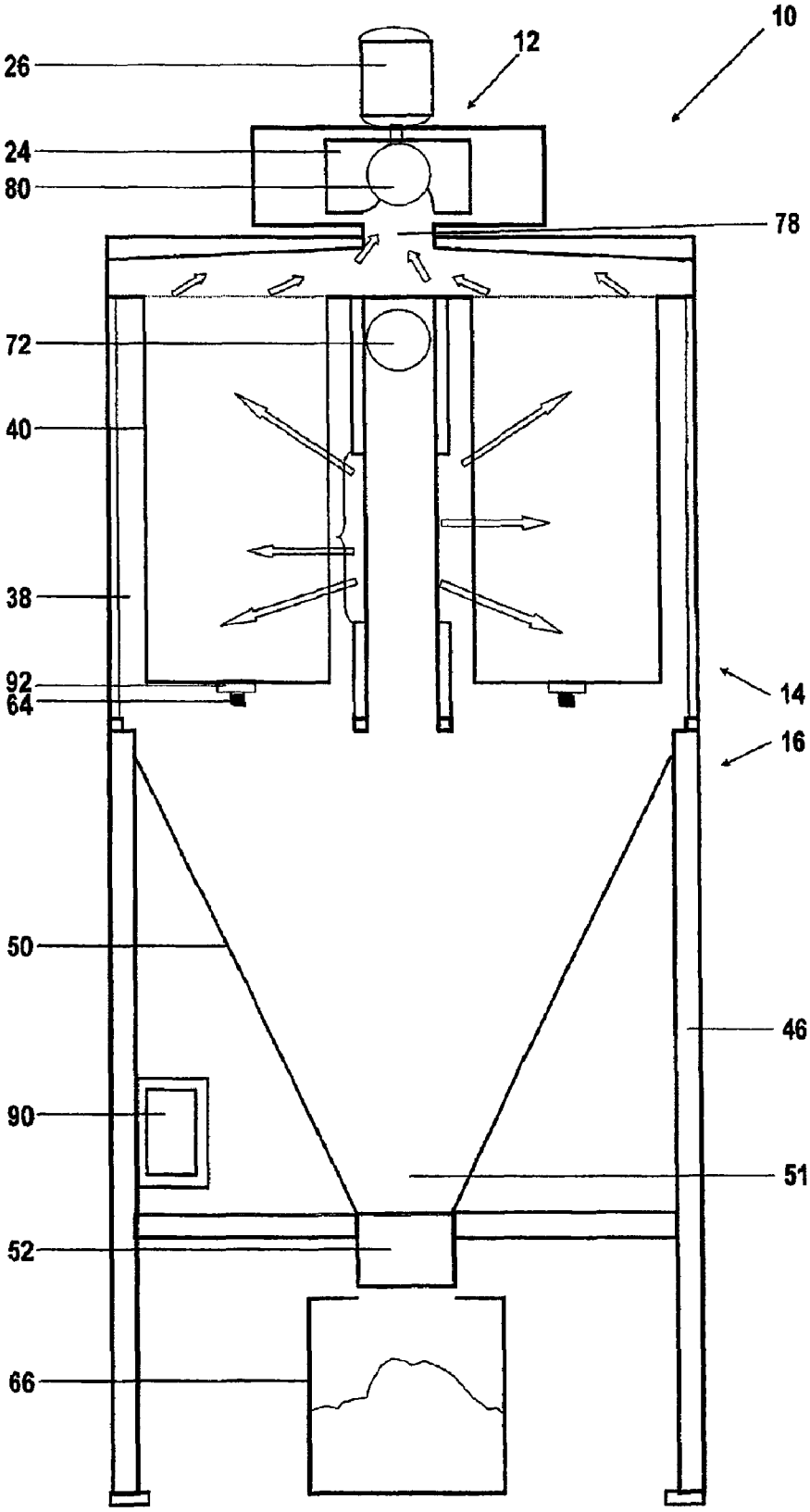
FIG. 2 is a left side view of the treatment unit of FIG. 1.
Figure 3:
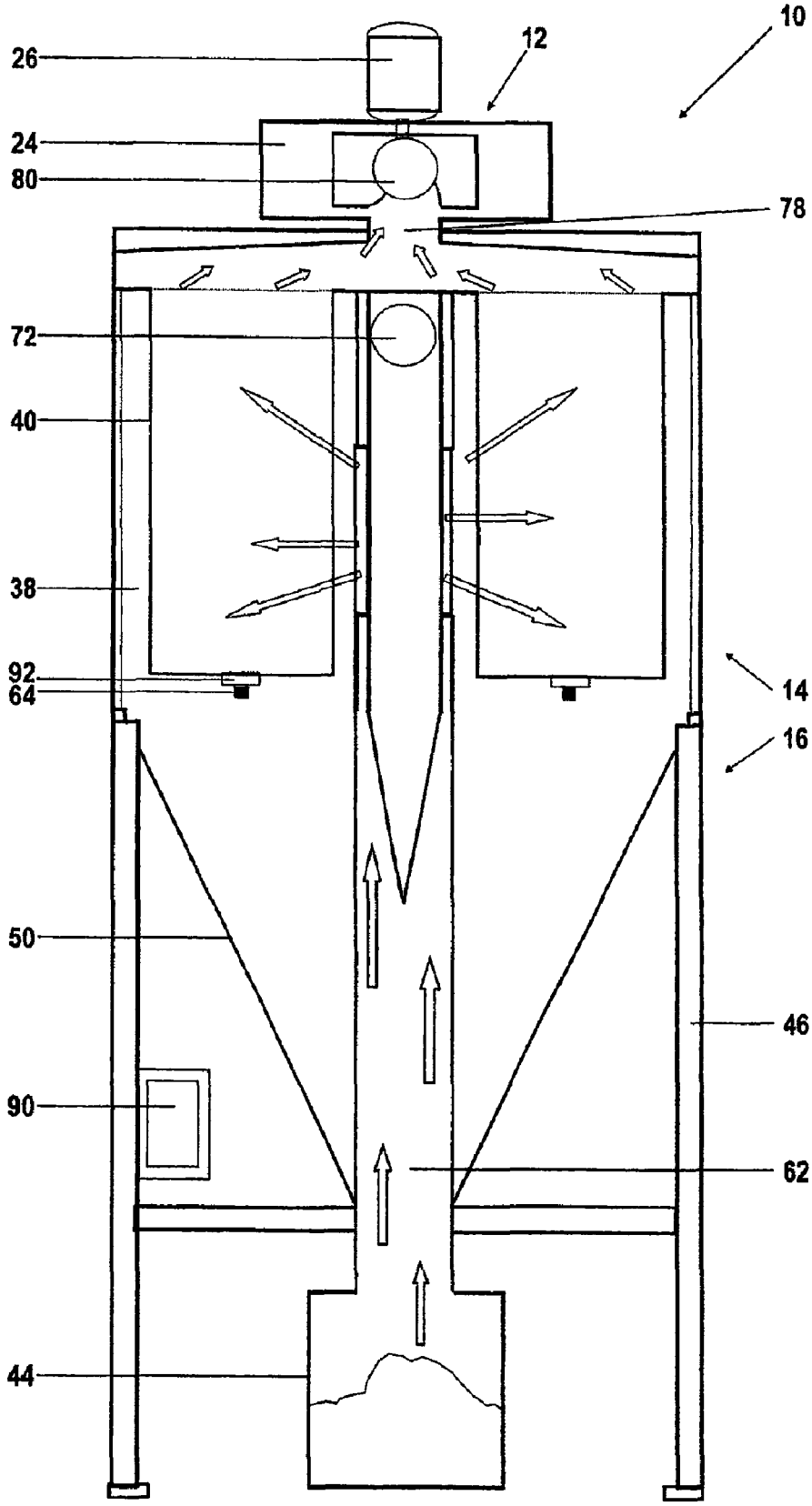
FIG. 3 is a right side view of the treatment unit of FIG. 1.
Figure 4:
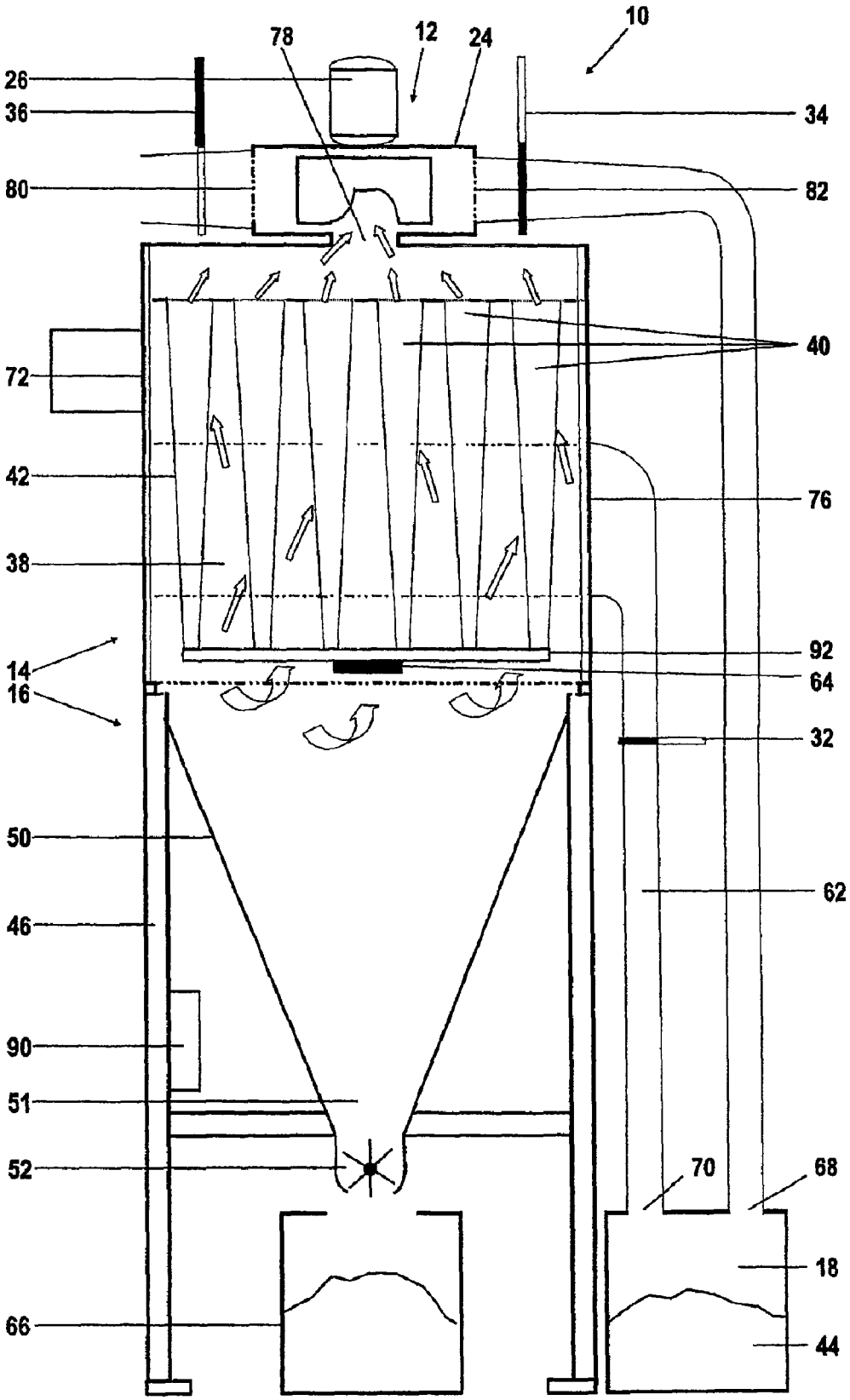
FIG. 4 is a front view of the treatment unit of FIG. 1.
Figure 5:
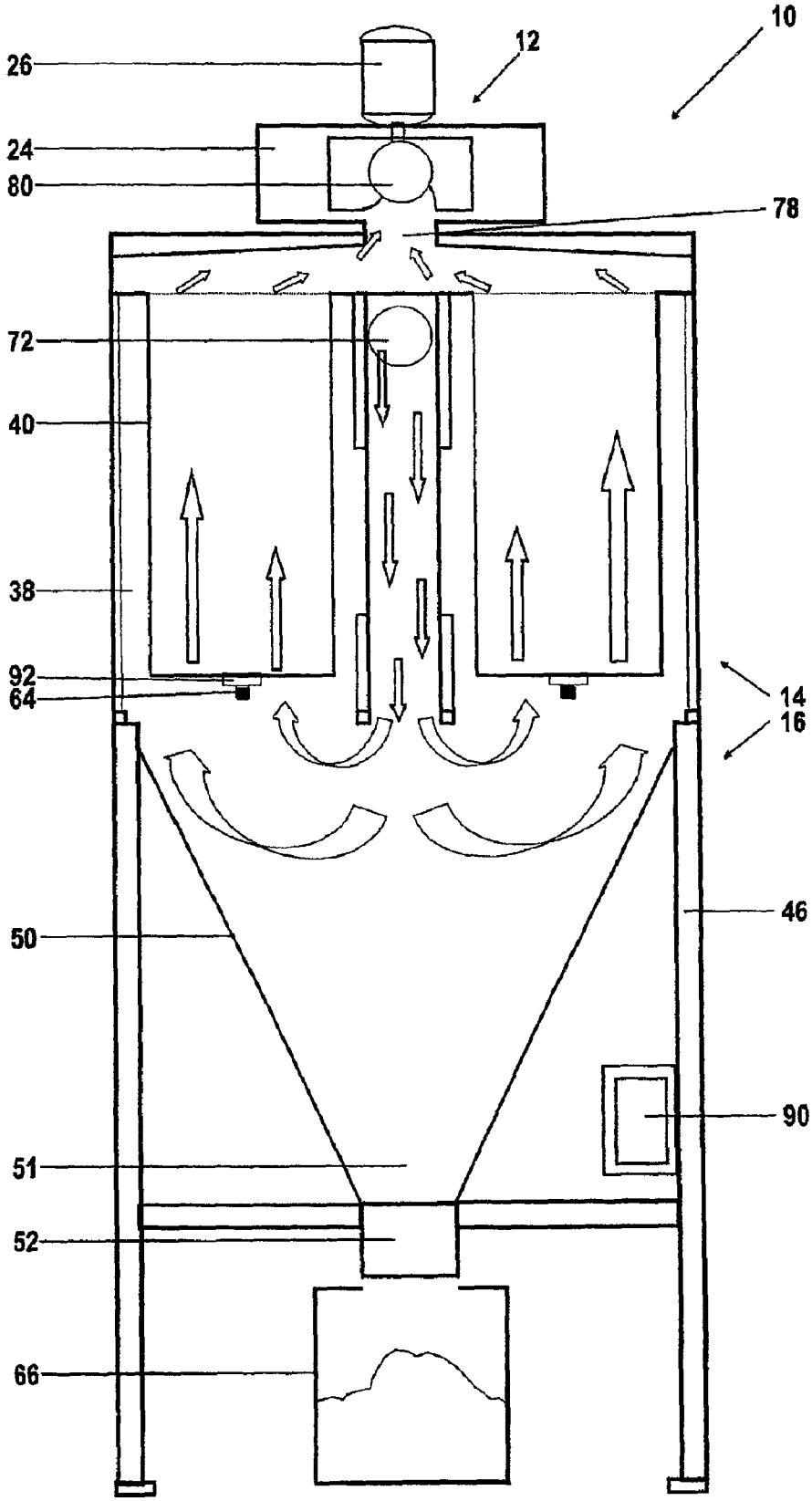
FIG. 5 is a left side view of the treatment unit of FIG. 4.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as additional items.

Referring initially to FIGS. 1 to 8 of the drawings, a treatment unit according to one embodiment of the present invention is shown generally at 10. The treatment unit 10 treats, cleans or purifies polluted gases such as smoke generated by a polluting source such as incinerators or boiler fires in factories, hospitals or other industries, to reduce both the number of particles in the gases or smoke and the volume of harmful gases before they are emitted into the environment. As shown in FIGS. 1, 4, 7 and 8, the treatment unit 10 includes a treatment (or filter) section 14 for receiving and treating polluted gases or smoke to be cleaned, a powder container 18 from which powder can flow to the treatment section 14 for creating a filtering layer cake, a vent section 12 for sucking cleaned gas from the treatment section 14 and polluted gases from a polluting source and for blowing an airflow to the powder container 18, a collector section 16 for collecting polluting particles from the treatment section 14 and a controller 90, such as a control panel, to direct the operations. Furthermore, depending of the nature of the polluted gases or smoke generated by a factory or the likes, the treatment system 10 could include a reactor 20 for injecting chemicals directly into the stream of the polluted gases or smoke before they reach the treatment section 14.

The treatment system of the present invention works in two distinct steps. In a first step, the system undergoes the formation of the filtering layer cake made of powders in the treatment section. Then, in a second step, the system initiates the treatment of the polluted gases or smoke by allowing their entrance into the treatment section and their passage through the filtering layer cake.

Figure 6:
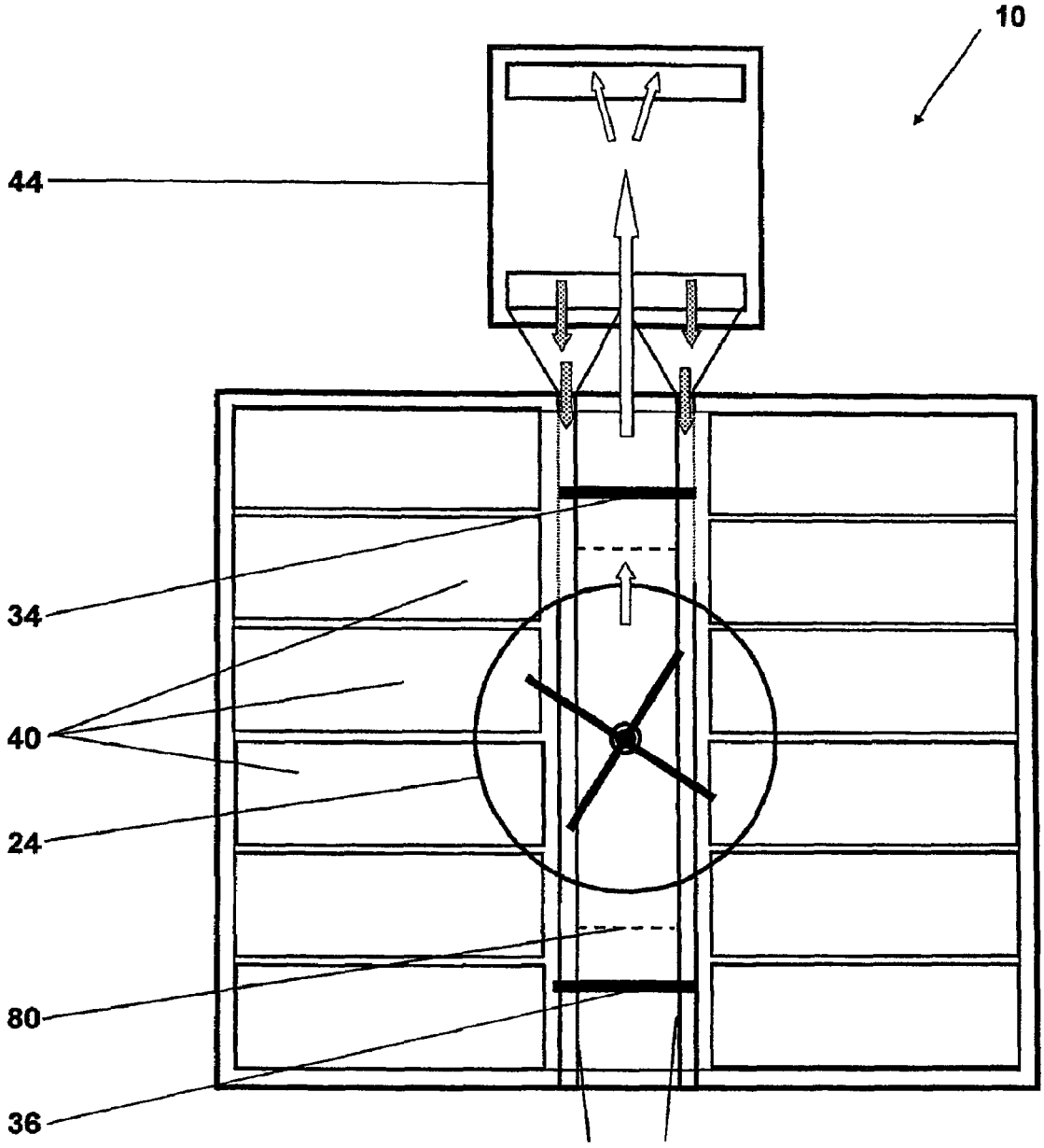
FIG. 6 is a top view of the treatment unit of FIG. 1 or FIG. 4.

More particularly, as shown in FIGS. 1 to 10, the treatment section 14 of the treatment unit 10 includes a filtration (or treatment) chamber 38 comprised of one or a plurality of filtering cells 40 for receiving the polluted gases or smoke and cleaning or purifying them with the help of filtering cells 40. The filtration chamber 38 has a first inlet 72 for polluted gases, and a second inlet 76 for the entrance of clean powders from the powder container 18, and one outlet 78 for evacuating cleaned gases. Each filtering cell 40 is prism shaped and is covered with a filtering membrane 42. By prism shaped is meant a triangular frame having two faces closer at one end than at the other end. The filtering cells used in the present invention are as described in U.S. Pat. No. 4,808,203 or Canadian patent no. 1,234,360. As illustrated in FIG. 6, the filtering cells 40 are arranged as two rows having six filtering cells 40 in each row, the rows being separated from one another. It will be understood that the number of rows and filtering cells 40 can vary. The filtering membrane 42 covering the filtering cell 40 is made of a mesh which is preferable heat resistant such as a stainless steel screen. In a preferred embodiment, the stainless steel is T-304 mesh Plain Dutch Weave, 80, 0.0049" by 400, 0028". The person skilled in the art will know which type of filtering membrane 42 has to be used having regard to the pollutants present in the incoming polluted gases or smoke. Furthermore, a vibrator device 64 attached to the filtering cells 40 by a vibrator bar 92 is included in the treatment unit 10. The vibrator device 64 can be activated via the control panel 90.

The powder container 18 of the treatment unit 10, as best seen in FIGS. 1, 4, 7 and 8, comprises powders 44 chosen according to the nature of the pollutants present in the incoming gases, one inlet 68 for allowing an airflow coming from the vent section 12 to enter the powder container and one outlet 70 connected to the inlet 76 of the treatment section 14 for allowing the air laden with powder particles 44 to enter the treatment section 14. The powders 44 used in the context of the present invention are mineral powders, for example, agricultural limestone or live lime 10%. Also, it will be understood that the treatment system of the present invention could include different kinds of powders, or mixtures of powders, for example, baking soda or fire extinguisher powder or salt. The powders 44 are chosen having regard to the nature of the pollutants present in the incoming gases. The skilled person will appreciate which types and sizes of powders can be used with a given pollutant. In operation, a layer of a powder 44 or a mixture of one or more powders is deposited onto the stainless steel screen of the filtering membrane 42. This will be further detailed below.

Figure 7:
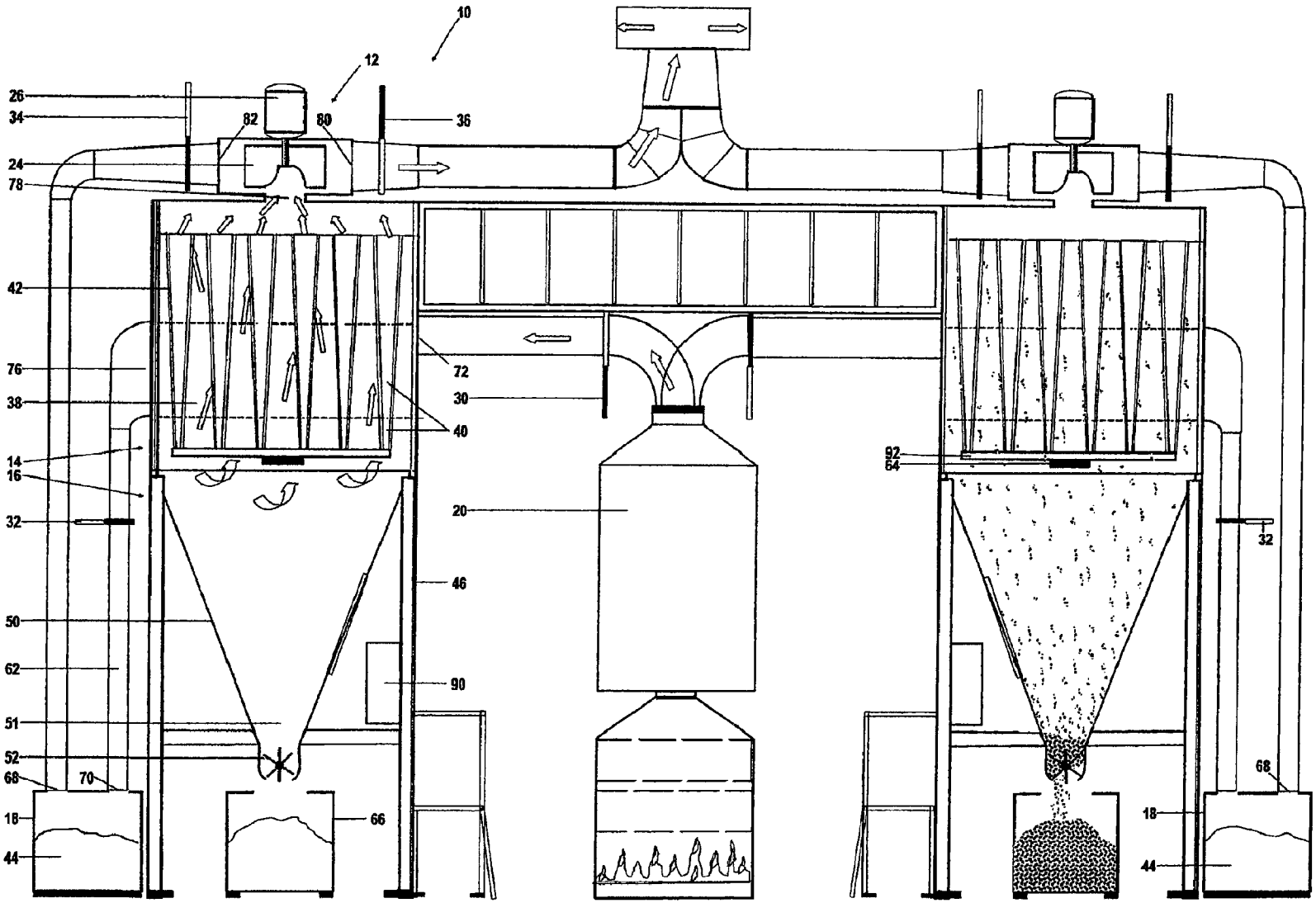
FIG. 7 is a front view of two of the treatment units of FIG. 7 in action, the one on the left engaging in the treatment process of FIG. 4 while the one on the right undergoes a cleaning process.
Figure 8:
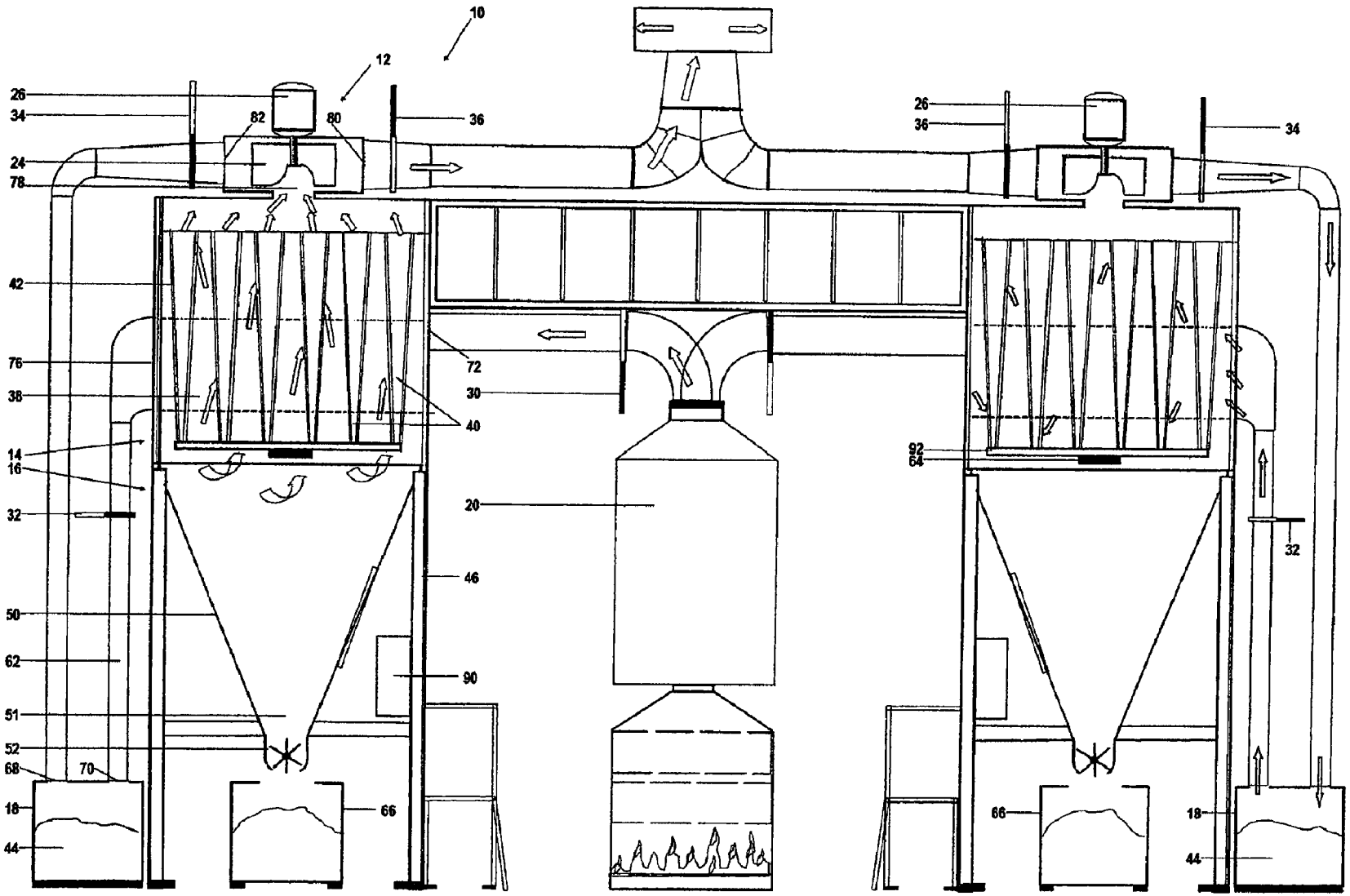
FIG. 8 is a front view of two of the treatment units of FIG. 7 in action, the one on the left engaging in the treatment process of FIG. 4 while the one on the right engages in a powder coating process of FIG. 1.
Figure 9A:
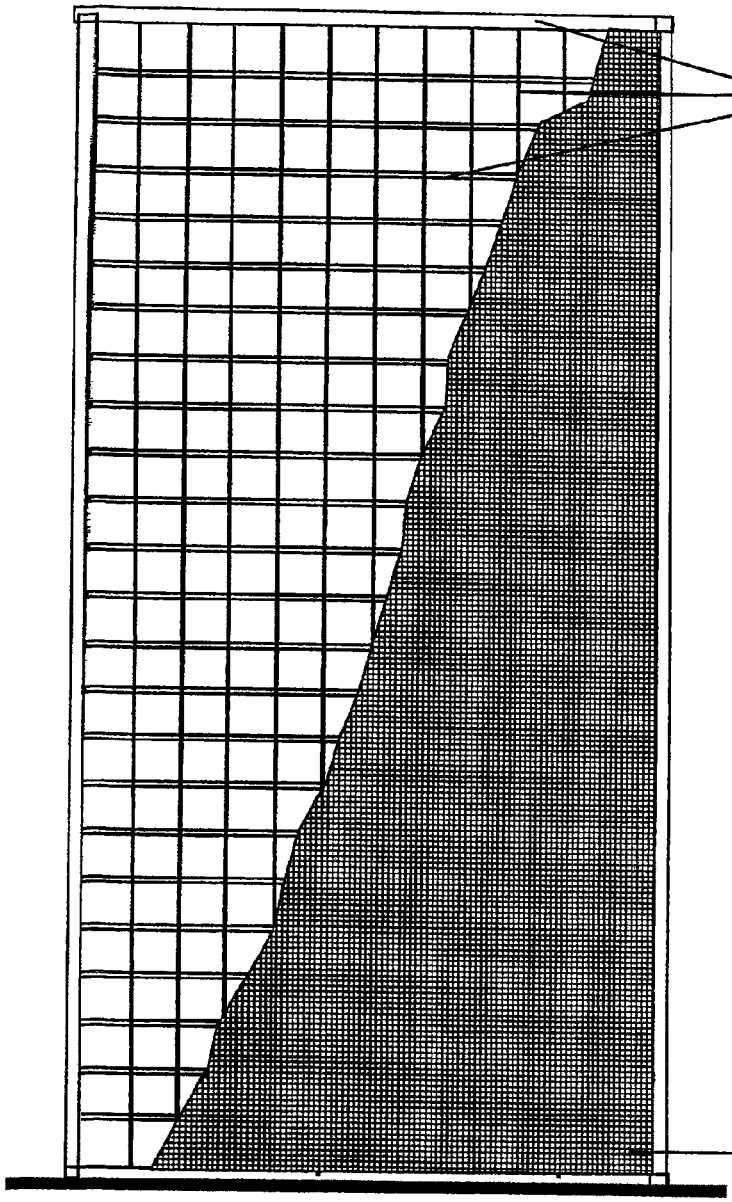
FIG. 9*a* is a front view of a filtering cell used in the treatment unit of FIG. 1 or FIG. 4.
Figure 10:
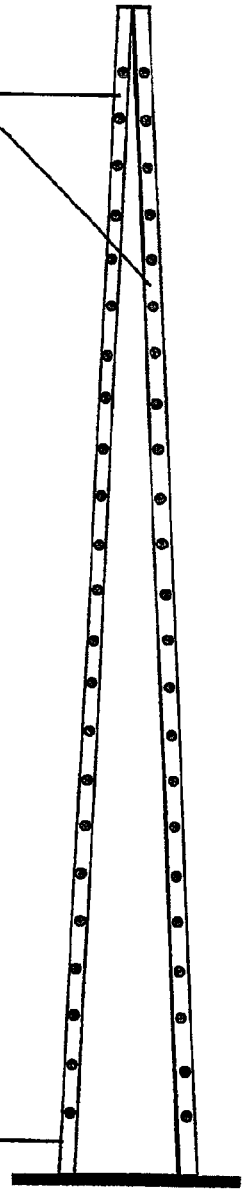
FIG. 10 is a side view of the filtering cells used of FIG. 9*a*.
Figure 9B:
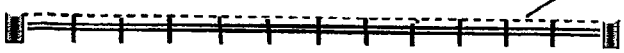
FIG. 9*b* is a cross-sectional view through the filtering cell of FIG. 9*a*.

The vent section 12 of the treatment unit 10, as best seen in FIGS. 7 and 8, includes two outlets, a first outlet 82 for transporting an airflow to the powder container 18 via inlet 68 and a second outlet 80 for evacuating cleaned gases before they are emitted, for example through a stack, and an inlet connected with the filtration chamber 38 of the treatment section 14 for transporting cleaned gases or an airflow from the filtration chamber 38 to the outlets 80 or 82. The vent section 12 of the present embodiment also includes a blower 24 driven by a motor 26 and a valves system 34, 36. The blower 24 has two different functions. During the first step of the treatment process, it sends an airflow via outlet 82 and inlet 68 into the powder container 18 for creating aerosols which are drawn to the stainless steel media of the filtering membrane 42 via outlet 70 and inlet 76 to form a filtering cake. During the second step of the process, when the polluted gases inlet 72 is opened to allow the entrance of the polluted gases to the treatment section 14, the blower 24 aspirates the air contained in the filtering cells 40 of the filtration chamber 38 thereby forcing the polluted gases that are outside the filtering cells 40 to cross the filtering membrane 42. The blower 24 and the motor 26 should be of sufficient power to effect the airflow described above.

The valve system 34, 36 of the vent section 12 includes polluted gas inlet valve 30 (FIG. 8) to manage the entrance of polluted gases into the filtration chamber, a purified gas valve 34 for controlling the flow of air from the blower 24 to the powder container 18, a gas and powder valve 32 for controlling the flow of the mineral powder aerosols to the filtration chamber 14 and a purified gas outlet valve 36 for controlling the emission of cleaned gases.

A system of pipes or conduits or any other known systems in the art links, joins or connects together the treatment section 14, the powder container 18 and the vent section 12. In a similar fashion, a system of pipes or conduits or the like links together the source of polluted gases with the treatment unit 10.

The collector section 16 of the treatment unit 10, as illustrated in FIGS. 1 to 5, 7 and 8, is located below the treatment section 14. The function of the collector section 16 is to collect the polluted particles and the contaminated powders retained on the filtering membrane 42. The collector section 16 is provided with a collector housing 46, an inlet that co-operates with the bottom of the treatment section 14, an outlet 51 and a mechanism that allows the expulsion of the polluted particles and the contaminated powders out of the treatment unit 10. In a preferred embodiment, the collector housing 46, as shown in FIGS. 1 to 5, 7 and 8, is a structure that supports a hopper 50 and the mechanism that allows the expulsion of the polluted particles and the contaminated powders out of the treatment unit 10, which mechanism is a discharge valve 52 located in the hopper outlet and controlled by the control panel 90. Of course, it will be appreciated that any types of mechanisms that allows the expulsion of the polluted particles and contaminated powders out of the treatment unit 10 could be used in embodiments of the present invention. Furthermore, an external container 66 for collecting the polluted particles and the contaminated powders is located below the hopper 50. The external container 66 is periodically emptied as required.

As shown in FIGS. 7 and 8, on their way to the filtration chamber 38 of the treatment unit 10, the contaminated gases, depending on their composition, could be put in contact by the chemical reactor 20, with products (e.g. particles, liquids, gases) which will react with particular gases and particles contained in the contaminated gases in order to suppress them or modify their composition. This could act as the first purifying or treatment step for neutralizing the contaminated gases or smoke before reaching the filtering membrane of the filtering cells 40. In a preferred embodiment, the chemical reactor 20 is of mechanical type and is activated by an electric motor (not shown) which is controlled by the control panel 90. The chemical reactor 20 could inject, for example, a wood charcoal powder, which will assist in reducing the mercury and lead level in the contaminated gases before reaching the filtration chamber 38. Of course, it will be understood that a person skilled in the art will choose the appropriate chemicals which could be used with a given contaminated gas.

In operation, the formation of the filtering cake on the filtering cells 40 is activated as follow. The purified gas valve 34 and the gas and powder valve 32 are opened via the control panel 90 which allows the circulation of an airflow from the vent section 12 to the powder container 18 and the treatment section 14 by means of the blower 24. More particularly, the blower 24 sends airflow to the powder container 18 via outlet 82 and inlet 68 which has the effect of creating aerosols 62 by agitating the powders 44 and mixing them with the airflow. At the same time, while the blower 24 is in operation, it aspirates or draws the powder aerosols 62 created by the presence of the airflow within the powder container 18 into the filtering chamber 38 of the treatment section 14 via outlet 70 and inlet 76. Initially, the air stream laden with powder aerosol 62 passes through the filtering membranes 42 and some of the powder particles are retained on the mesh screen of the filtering membranes 42. As more powder particles accumulate on the mesh screen, the filtering membrane openings become smaller and smaller. Indeed, on posterior passages of the air-powder mixture 62 through the membrane 42, the mesh screen will capture smaller and smaller powder particles creating a filtering cake which will grow in thickness. The filtering cake will create a pressure differential between the inside and outside surfaces of the filtering cells. This pressure differential can provide an indication that an adequate thickness of the filtering cake has been achieved.

The control panel 90 may ascertain this by comparing the measured pressure difference with a pre-set value. At this point, the control panel 90 closes valves 32, 34 leading to and from the powder container 18 to isolate the powder container 18 within the system. Valve 30 is opened to allow the polluted gases from the polluted gas source to enter the filtration chamber 38 of the treatment section 14 via inlet 72. As a result of this operation, the loop that allows the air stream to go from the blower 24 to the powder container 18 and from the powder container 18 to treatment section 14 is closed.

In the meantime, the blower 24 keeps aspirating air from the inside of the filtering cells 40 of the filtration chamber 38 creating a differential pressure between the two sides of the filtration membrane 42 that forces the air to cross the membrane 42 from the outside to the inside. Therefore, the polluted gases, i.e. the contaminated gases, enter the filtration chamber 38 of the treatment section 14 and are drawn to the filtering cell membranes 42. At that moment, the larger particles contained in the polluted gases or smoke are retained by the filtering cake created by the powder particles. Furthermore, interaction between the molecules present in the polluted gases and the powder particles of the filtering cake on the mesh screen can result in various chemical reactions to modify the composition of the polluted gases and/or to create solid compounds. These solid compounds will be retained on the filtering membranes 42. The cleaned gases are emitted from the treatment unit 10 via the purified gas outlet valve 36, for example through a chimney or an industrial stack.

As the gas treatment continues, the filtering cake porosity decreases and the contaminated gas stream through the filtering cells is increasingly restricted. Consequently, the pressure differential in the filtering chamber 38 is monitored so that when the contaminated gas flow reaches a predetermined flow rate or pressure, the process/method can be stopped for cleaning to the treatment unit, by stopping the blower 24 for example. During this cleaning phase, the vibrator device 64 attached to the treatment unit 10 by the vibrator bar 92 is activated via the control panel 90, or in any other suitable way, which causes some or all of the filtering cake made of powder particles and the polluting material aggregated to the mesh screen to break away and to fall by gravity into the hopper 16. When the hopper 16 contains a given amount of rejected material, the expulsion mechanism 52 is activated and the refuse is collected in the external containers 66. By means of the vibrator 64, the filtering membranes 42 can be freed of some or all particles and powder particles. It is then possible to restart the cycle by reforming the filtering cake with the mineral powders on the mesh screen.

The treatment unit 10 may be provided without the vibration device 64. Instead, when the filtering cake made of powder particles and the polluted material aggregated on the mesh screen attains a given level, a portion of it will be allowed to eventually fall, by gravity, into the hopper 16 or the mesh screen cleaned manually. Other mesh screen cleaning methods are also possible.

The treatment unit 10 of the present invention can be operated on a continuous basis due to the plurality of treatment units 10 which work in parallel. This is advantageous because when a treatment unit 10 undergoes a cleaning phase or has an operational problem, the other units 10 may handle the filtration needs of the polluting source without causing the entire treatment process to be stopped for a certain period of time. FIGS. 7 and 8 show two treatment units 10 of the present embodiment installed side-by-side.

While a preferred embodiment of the present invention has been illustrated and described herein, it will be appreciated that various changes and modifications as may be therein without departing from the spirit of the invention as defined by the scope of the appended claims. For example, instead of a blower, any other device, apparatus or propulsion means to cause air to flow can be used. For example, instead of the air in the system being sucked, it can also be blown. It will also be understood that the filtering cells and the filtering layer cake do not only filter and can perform other treatment processes instead of or as well as filtering.

The invention claimed is:

1. A system for treating polluted gas, the system comprising:

a treatment chamber having an inlet for receiving polluted gas and an outlet for expelling a treated gas, the treatment chamber including at least one treatment cell having a filtering layer for treating the polluted gas when the polluted gas passes through the filtering layer;

a container, for containing a powder, connected to the treatment chamber such that air flows from the treatment chamber to the container and such that air laden with the powder can flow to the treatment chamber to form the filtering layer on the at least one treatment cell; and an air flow generator connected to the outlet of the treatment chamber and to the container for causing air flow from the treatment chamber to the container and from the container to the treatment chamber.

2. The system of claim 1, wherein said air flow generator comprises an air blower.

3. The system of claim 1, wherein said air flow generator comprises a first outlet for allowing air flowing to said container and a second outlet expelling said treated gas outside said system.

4. The system of claim 1, wherein said treatment cell is prism shaped and covered with a filtering membrane.

5. The system of claim 1, wherein said treatment chamber comprises a plurality of treatment cells arranged in at least one row.

6. The system of claim 4, wherein said filtering membrane is a mesh.

7. The system of claim 4, wherein said filtering membrane is heat resistant.

8. The system of claim 4, wherein said filtering membrane is a stainless steel screen.

9. The system of claim 1, wherein said treatment chamber comprises two rows of six filtering cells therein.

10. The system of claim 1, wherein said treatment cell comprises a vibrator device attached thereon.

11. The system of claim 1, wherein said powder is a mineral or chemical powder.

12. The system of claim 1, wherein said powder is a mixture of at least two powders of different nature.

13. The system of claim 1, wherein said air flow generator comprises a valve for controlling the entrance of polluted gas into said treatment chamber.

14. The system of claim 1, wherein said air flow generator comprises a valve for controlling the emission of said treated gas outside said system.

15. The system of claim 1, wherein said air flow generator further comprises a valve for controlling the flow of air to the container.

16. The system of claim 1, wherein said treatment chamber further comprises a collector section located below the at least one treatment chamber for collecting polluted particles and contaminated powders resulting from the treatment of said polluted gas.

* * * * *